US006132479A

United States Patent [19]

Welstand et al.

[11] Patent Number: 6,132,479

[45] Date of Patent: Oct. 17, 2000

[54] LOW EMISSION, NON-OXYGENATED FUEL COMPOSITION

[75] Inventors: Joseph S. Welstand, Pinole; John Freel, Novato; William R. Scott, El Cerrito; Michael J. Fuchs, Rancho Palos Verdes; Scott R. Brundage, Richmond, all of Calif.

[73] Assignee: Chevron U.S.A. Inc., San Ramon, Calif.

[21] Appl. No.: 09/071,543

[22] Filed: May 4, 1998

[51] Int. Cl.[7] ..... C10L 1/06

[52] U.S. Cl. ..... 44/300; 585/14

[58] Field of Search ..... 585/14; 44/300

[56] References Cited

U.S. PATENT DOCUMENTS

| | | | |
|---|---|---|---|
| 5,288,393 | 2/1994 | Jessup et al. | 208/15 |
| 5,346,609 | 9/1994 | Fletcher et al. | 208/89 |
| 5,401,280 | 3/1995 | Kaneko et al. | 44/449 |
| 5,593,567 | 1/1997 | Jessup et al. | 208/46 |
| 5,653,866 | 8/1997 | Jessup et al. | 208/46 |
| 5,814,111 | 9/1998 | Graham et al. | 44/443 |
| 5,837,126 | 11/1998 | Jessup et al. | 208/16 |

*Primary Examiner*—Ellen M. McAvoy
*Attorney, Agent, or Firm*—Burns, Doane, Swecker & Mathis, L.L.P.

[57] ABSTRACT

Provided is an unleaded gasoline fuel which is substantially free of oxygenates, i.e., the fuel contains less than 1.0 weight percent oxygen based on the total weight of the fuel composition, and most preferably contains no oxygen containing compounds. The gasoline fuel of the present invention also has a Reid vapor pressure of less than 7.5 psi, a sulfur content of less than 30 ppmw, and more preferably less than 20 ppmw sulfur, and an aromatic hydrocarbon content greater than 30 volume percent and/or a 50% D-86 Distillation Point greater than 220° F. and/or a 90% D-86 Distillation Point greater than 330° F. The gasoline fuel preferably also has an olefin content of no greater than 8 volume percent, and more preferably 5 volume percent or less. It has been found that such a gasoline fuel offers a substantially oxygenate free gasoline which avoids the environmental impact of oxygenates, yet when combusted in an internal combustion automobile provides good performance and good emissions.

25 Claims, 1 Drawing Sheet

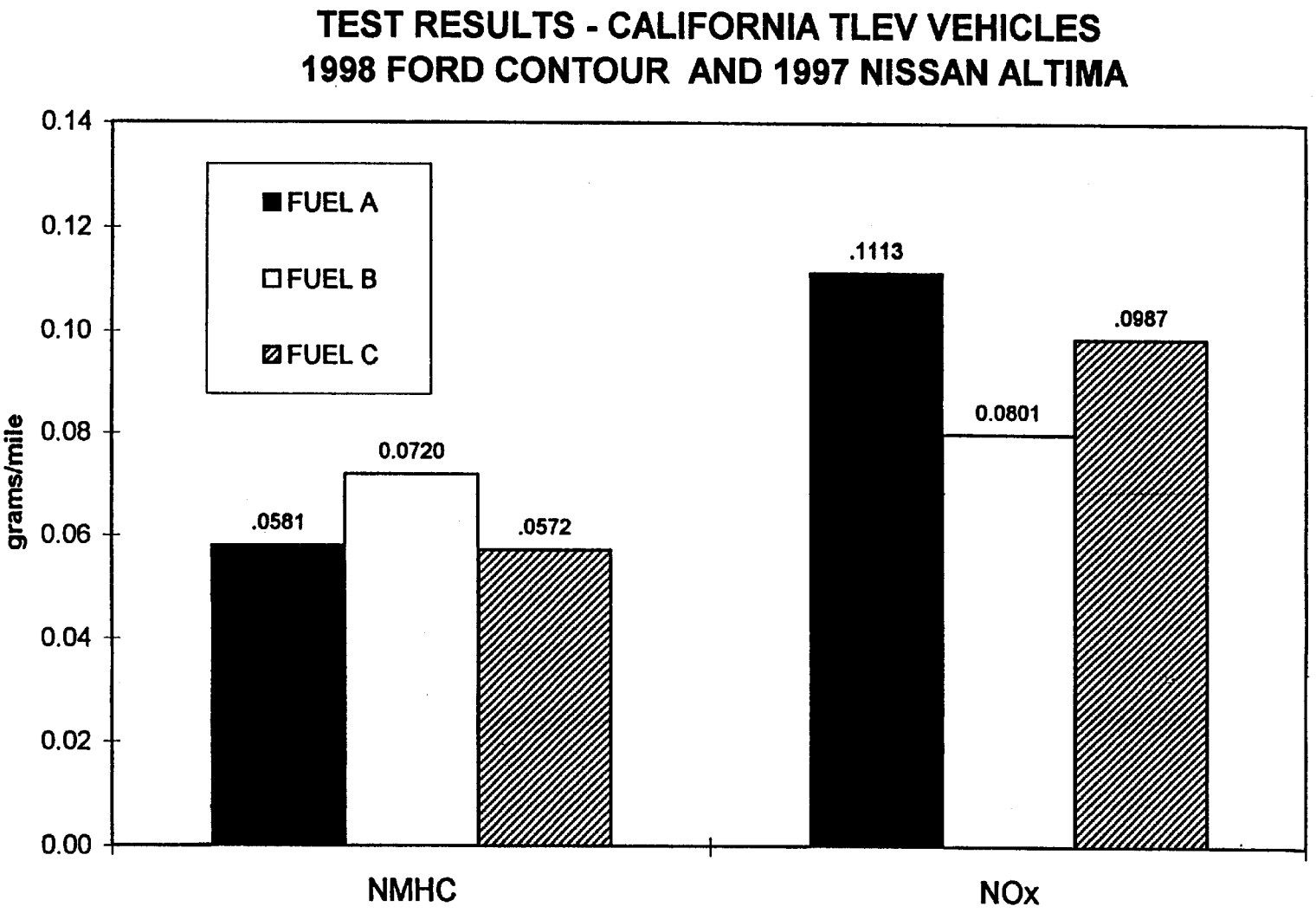
FIGURE

LOW EMISSION, NON-OXYGENATED FUEL COMPOSITION

BACKGROUND OF THE INVENTION

1. Field of the Invention

The present invention relates to fuels, particularly gasoline fuels which are substantially free of oxygenates. More specifically, the present invention relates to a low-emission gasoline fuel which, upon combustion in a spark-ignited engine, provides surprisingly low emissions, particularly of nitrogen oxide emissions, and is also substantially free of oxygen-containing compounds.

2. Description of the Prior Art

One of the major environmental problems confronting the United States and other countries is atmospheric pollution caused by the emission of pollutants in the exhaust gases and gasoline vapor emissions from gasoline fueled automobiles. This problem is especially acute in major metropolitan areas where atmospheric conditions and the great number of automobiles result in aggravated conditions. While vehicle emissions have been reduced substantially, air quality still needs improvement. The result has been that regulations have been passed to further reduce such emissions by controlling the composition of gasoline fuels. These specially formulated, low emission gasolines are often referred to as reformulated gasolines. In California, low emissions gasoline is often referred to as California Phase 2 gasoline. One of the requirements of these gasoline regulations is that, in certain geographic areas, oxygen-containing hydrocarbons, or oxygenates, be blended into the fuel.

Congress and regulatory authorities, such as CARB (the California Air Resources Board), have focused on setting specifications for low emissions, reformulated gasoline. The specifications, however, require the presence of oxygenates in gasoline sold in areas that are not in compliance with federal ambient air quality standards for ozone, and the degree of non-attainment is classified as severe, or extreme. Among the emissions which the reformulated gasoline is designed to reduce, are nitrogen oxides ($NO_x$), hydrocarbons (HC), and toxics (benzene, 1,3-butadiene, formaldehyde and acetaldehyde). A reduction in these emissions has been targeted due to their obvious impact upon the air we breathe and the environment in general.

There is increasing attention from environmental agencies regarding the need for a reduction in emissions of nitrogen oxides. $NO_x$ emissions are known precursors for smog created in metropolitan areas. Most of the $NO_x$ emissions are man-made, with gasoline fueled engines generating about 24% of the man-made $NO_x$ emissions. NO is the major constituent of $NO_x$ emissions from combustion processes. NO is a precursor of $NO_2$ in the atmosphere and a critical constituent in the formation of ozone. $NO_2$ can irritate the lungs and reduce respiratory function. $NO_x$ can be an important precursor to secondary formation of particulates, according to the "National Air Quality and Emission Trends Report," 1992, Office of Air Quality Planning and Standards, U.S. Environmental Protection Agency, EPA 454/R-93-031, October 1993. A reduction of nitrogen oxides, particularly in large metropolitan areas such as Los Angeles and Sacramento, Calif., and many eastern U.S. states, would be most valuable. As a consequence of all these harmful effects, the reformulated gasolines have been designed to reduce $NO_x$ emissions.

Oxygenated gasoline is a mixture of conventional hydrocarbon-based gasoline and one or more oxygenates. Oxygenates are combustible liquids which are made up of carbon, hydrogen and oxygen. All the current oxygenates used in reformulated gasolines belong to one of two classes of organic molecules: alcohols and ethers. The Environmental Protection Agency regulates which oxygenates can be added to gasoline and in what amounts.

The primary oxygen-containing compound employed in gasoline fuels today is methyl tertiary butyl ether (MTBE). While oxygen is in most cases required in reformulated gasolines to help effect low emissions, the presence of oxygenates in gasoline fuels has begun to raise legitimate environmental concerns. For example, the oxygenate methyl tertiary butyl ether has been observed in drinking water reservoirs, and in a few instances, ground water in certain areas of California. As a result, the public is beginning to question the benefits and/or importance of having cleaner burning gasolines, if they simply pollute the environment in other ways. Furthermore, oxygenates also have a lower thermal energy content than non-oxygenated hydrocarbons, and therefore reduce the fuel economy of gasoline fueled motor vehicles.

Thus, while some of the concerns with regard to gasoline fuels containing oxygenates, such as methyl tertiary butyl ether, could be overcome by further safe handling procedures and the assessment of present facilities to reduce the risk of any spills and leaks, there remains a growing public concern with regard to the use of oxygenates in gasoline fuels. In an effort to balance the need for lower emission gasolines and concerns about the use of oxygenates it, therefore, would be of great benefit to the industry if a cleaner burning gasoline without oxygenates could be made. A cleaner burning gasoline resulting in low $NO_x$ emissions would be of particular benefit to the environment in light of the increased attention to reducing nitrogen oxide emissions. The availability of such a gasoline, which contained substantially no oxygenates, would allow the public to realize the environmental benefits of low emissions, yet ease the concern of potential contamination of ground waters, and the environment in general, with oxygenates. Of benefit to the industry would also be such a low emission, gasoline which contained substantially no oxygenates and also offered more flexibility to refiners in blending the gasoline.

Accordingly, it is an object of the present invention to provide a gasoline fuel which can truly benefit the environment and offer good performance.

It is another object of the present invention to provide a gasoline fuel which provides good emissions, yet is substantially free of oxygenates.

Yet another object of the present invention is to provide a low-emission, substantially oxygenate-free gasoline fuel which exhibits surprisingly low $NO_x$ emissions when combusted in an automobile internal combustion engine.

Still another object of the present invention is to provide a gasoline fuel which provides good emissions and also permits more flexibility to refiners in blending the gasoline.

These and other objects of the present invention will become apparent upon a review of the following specification and the claims appended thereto.

SUMMARY OF THE INVENTION

In accordance with the foregoing objectives, the present invention provides an unleaded gasoline fuel which is substantially free of oxygenates, i.e., the fuel contains less than 1.0 weight percent oxygen based on the total weight of the fuel composition, and most preferably contains no oxygen containing compounds. The gasoline fuel of the present invention also has a Reid vapor pressure of less than 7.5 psi, a sulfur content of less than 30 ppmw, and more preferably less than 20 ppmw sulfur. The fuel of the present invention also has an aromatic hydrocarbon content greater than 30 volume percent and/or a 50% D-86 Distillation Point greater than 220° F. and/or a 90% D-86 Distillation Point greater than 330° F. The gasoline fuel preferably also has an olefin content of 8 volume percent or less, and more preferably 5 volume percent or less. It has been found that such a gasoline fuel offers substantially oxygenate free gasoline which avoids the environmental impact of oxygenates, yet when combusted in an internal combustion automobile engine provides good performance and good emissions.

In particular, surprisingly low $NO_x$ emissions have been observed for the gasoline fuels of the present invention, with the $NO_x$ emissions being substantially lower than that predicted by the California Predictive Model established by the California Air Resources Board (CARB). Good performance with surprisingly low $NO_x$ emissions is obtained despite the fact that the gasoline fuel of the present invention does not meet the specifications for the CARB reformulated gasoline fuel. The gasoline composition of the present invention is substantially free of oxygenates, and it also exceeds the cap limits set for at least one, if not more, of the properties regulated by the specifications for the new (Phase 2) reformulated gasoline. Nevertheless, despite not meeting the specifications for properties required by CARB for reformulated gasolines, the gasoline fuel of the present invention allows one to enjoy good emissions, and particularly surprisingly low $NO_x$ emissions, while also avoiding the potential problems of oxygenates. For it has been surprisingly found that when one controls the amount of sulfur in accordance with the present invention to less than 30 ppmw (and more preferably less than 20 ppmw), and in particular controls the amount of sulfur together with olefins in accordance with the present invention to no greater than 8 volume %, it is possible to have flexibility with respect to the other regulated fuel properties in a non-oxygenated fuel without sacrificing low emissions.

In another embodiment of the present invention, there is provided a method for operating an automotive vehicle having a spark-ignited, internal combustion engine. The method comprises introducing into the engine an unleaded gasoline which is substantially free of oxygenates in accordance with the present invention. The unleaded gasoline is then combusted in the engine. In a preferred embodiment, the automotive vehicle also has a catalytic converter into which at least some of the engine exhaust emissions created by combusting the unleaded gasoline are introduced, with the resulting emissions then being discharged from the catalytic converter and subsequently to the atmosphere. Good performance and surprisingly low $NO_x$ emissions are realized upon using the unleaded gasoline of the present invention in the operation of an automobile.

BRIEF DESCRIPTION OF THE DRAWING

The FIGURE of the Drawing graphically depicts the results of Example 1.

DETAILED DESCRIPTION OF THE INVENTION

The present invention is directed to gasoline compositions having properties which minimize the amount of exhaust pollutants, particularly nitrogen oxides, emitted during combustion, while also overcoming the potential detrimental impact, environmental and otherwise, of oxygenates. In particular, the gasoline formulations of the present invention provide emissions of nitrogen oxides which are surprisingly low in that they are much lower than predicted by the California Predictive Model developed by CARB. While the compositions of the present invention offer such surprising low emissions, as well as good performance as a gasoline, they also offer the advantage of avoiding the problems inherent with oxygenates, as the gasoline formulations of the present invention are substantially free of oxygenates.

Gasolines are well known fuels, generally composed of a mixture of numerous hydrocarbons having different boiling points at atmospheric pressure. Thus, a gasoline fuel boils or distills over a range of temperatures, unlike a pure compound. In general, a gasoline fuel will distill over the range of from about room temperature to 437° F. (225° C.). This temperature range is approximate, of course, and the exact range will depend on the refinery streams used to blend the gasoline and the environmental requirements for the resultant gasoline. The distillation profile of the gasoline can also be altered by changing the mixture in order to focus on certain aspects of gasoline performance, depending on the time of year and geographic location in which the gasoline will be used.

Gasolines are therefore, typically composed of a hydrocarbon mixture containing aromatics, olefins, and paraffins, with reformulated gasoline most often containing an oxygen compound, i.e., an oxygenate such as methyl tertiary butyl ether. Gasolines may also contain various additives, such as deposit control additives, demulsifiers, corrosion inhibitors, and antioxidants. The fuels contemplated in the present invention are unleaded gasolines (herein defined as containing a concentration of lead no greater than 0.05 gram of lead per gallon which is 0.013 gram of lead per liter). The preferred fuels will also have a Research Octane Number (RON) of at least 90. The anti-knock value (R+M)/2 for regular gasoline is generally at least 87 and for premium at least 92.

In an attempt to reduce harmful emissions upon the combustion of gasoline fuels, regulatory boards as well as Congress have developed certain specifications for reformulated gasolines. One such regulatory board is that of the State of California, i.e., the California Air Resources Board (CARB). In 1991, specifications were developed by CARB for California gasolines which, based upon testing, should provide good performance and low emissions. The specifications and properties of the reformulated gasoline, which is referred to as Phase 2 reformulated gasoline or California Phase 2 gasoline, are shown in Table 1 below.

TABLE 1

Properties and Specifications for Phase 2 Reformulated Gasoline

| Fuel Property | Units | Flat Limit | Averaging Limit | Cap Limit |
|---|---|---|---|---|
| Reid vapor pressure (RVP) | psi, max. | 7.00[1] | | 7.00 |
| Sulfur (SUL) | ppmw | 40 | 30 | 80 |
| Benzene (BENZ) | vol. %, max. | 1.00 | 0.80 | 1.20 |
| Aromatic HC (AROM) | vol. %, max. | 25.0 | 22.0 | 30.0 |
| Olefin (OLEF) | vol. %, max. | 6.0 | 4.0 | 10.0 |
| Oxygen (OXY) | wt. % | 1.8 (min)<br>2.2 (max) | | 1.8 (min)<br>2.7 (max)[2] |
| Temperature at 50% distilled ($T_{50}$) | deg. F. | 210 | 200 | 220 |

TABLE 1-continued

Properties and Specifications for Phase 2 Reformulated Gasoline

| Fuel Property | Units | Flat Limit | Averaging Limit | Cap Limit |
|---|---|---|---|---|
| Temperature at 90% distilled (T90) | deg. F. | 300 | 290 | 330 |

[1]Applicable during the summer months identified in 13 CCR, sections 2262.1(a) and (b).
[2]Applicable during the winter months identified in 13 CCR, sections 2262.5(a).

In Table 1, as well as for the rest of the specification, the following definitions apply:

Aromatic hydrocarbon content (Aromatic HC, AROM) means the amount of aromatic hydrocarbons in the fuel expressed to the nearest tenth of a percent by volume in accordance with 13 CCR (California Codes of Regulations), section 2263.

Benzene content (BENZ) means the amount of benzene contained in the fuel expressed to the nearest hundredth of a percent by volume in accordance with 13 CCR, section 2263.

Olefin content (OLEF) means the amount of olefins in the fuel expressed to the nearest tenth of a percent by volume in accordance with 13 CCR, section 2263.

Oxygen content (OXY) means the amount of actual oxygen contained in the fuel expressed to the nearest tenth of a percent by weight in accordance with 13 CCR, section 2263.

Potency-weighted toxics (PWT) means the mass exhaust emissions of benzene, 1,3-butadiene, formaldehyde, and acetaldehyde, each multiplied by their relative potencies with respect to 1,3-butadiene, which has a value of 1.

Predictive model means a set of equations that relate emissions performance based on the properties of a particular gasoline formulation to the emissions performance of an appropriate baseline fuel.

Reid vapor pressure (RVP) means the vapor pressure of the fuel expressed to the nearest hundredth of a pound per square inch in accordance with 13 CCR, section 2263.

Sulfur content (SUL) means the amount by weight of sulfur contained in the fuel expressed to the nearest part per million in accordance with 13 CCR, section 2263.

50% distillation temperature (T50) means the temperature at which 50% of the fuel evaporates expressed to the nearest degree Fahrenheit in accordance with 13 CCR, section 2263.

90% distillation temperature (T90) means the temperature at which 90% of the fuel evaporates expressed to the nearest degree Fahrenheit in accordance with 13 CCR, section 2263.

Toxic air contaminants means exhaust emissions of benzene, 1,3-butadiene, formaldehyde, and acetaldehyde.

The pollutants addressed by the foregoing specifications include oxides of nitrogen ($NO_x$) and hydrocarbons (HC) which are generally measured in units of gm/mile, and potency-weighted toxics (PWT), which are generally measured in units of mg/mile.

The Phase 2 reformulated gasoline regulations define a comprehensive set of specifications for gasoline (Table 1). These specifications have been designed to achieve large reductions in emissions of criteria and toxic air contaminants from gasoline-fueled vehicles. Gasolines which do not meet the specifications are believed to be inferior with regard to the emissions which result from their use in vehicles. All gasolines sold in California, beginning Jun. 1, 1996, have had to meet CARB's Phase 2 requirements as described below. The specifications address the following eight gasoline properties:

Reid vapor pressure (RVP)

Sulfur

Oxygen

Aromatic hydrocarbons

Benzene

Olefins

Temperature at which 90 percent of the fuel has evaporated (T90)

Temperature at which 50 percent of the fuel has evaporated (T50)

The Phase 2 gasoline regulations include gasoline specifications that must be met at the time the gasoline is supplied from the production facility. Producers have the option of meeting either "flat" limits or, if available, "averaging" limits, or, alternatively a Predictive Model equivalent performance standard.

The flat limits must not be exceeded in any gallon of gasoline leaving the production facility. For example, the aromatic content of gasoline, subject to the flat limit, could not exceed 25 volume percent (see Table 1).

The averaging limits for each fuel property established in the regulations are numerically more stringent than the comparable flat limits for that property. Under the averaging option, the producer may assign differing "designated alternative limits" (DALs) to different batches of gasoline being supplied from the production facility. Each batch of gasoline must meet the DAL assigned for the batch. In addition, a producer supplying a batch of gasoline with a DAL less stringent than the averaging limit must, within 90 days before or after, supply from the same facility sufficient quantities of gasoline subject to more stringent DALs to fully offset the exceedances of the averaging limit.

The Phase 2 gasoline regulations also contain "cap" limits. The cap limits are absolute limits that cannot be exceeded in any gallon of gasoline sold or supplied throughout the gasoline distribution system. These cap limits are of particular importance when the California Predictive Model or averaging is used.

A mathematical model, the California Predictive Model, has also been developed by CARB to allow refiners more flexibility. Use of the predictive model is designed to allow producers to comply with the Phase 2 gasoline requirements by producing gasoline to specifications slightly different from either the averaging or flat limit specifications set forth in the regulations. However, producers must demonstrate that the alternative Phase 2 gasoline specifications will result in equivalent or lower emissions compared to Phase 2 gasoline meeting either the flat or averaging limits as indicated by the Predictive Model. Further, the cap limits must be met for all gasoline formulations, even alternative formulations allowed under the California Predictive Model. When the Predictive Model is used, the eight parameters of Table 1 are limited to the cap limits.

In general, the California Predictive Model is a set of mathematical equations that allows one to compare the expected exhaust emissions performance of a gasoline with a particular set of fuel properties to the expected exhaust emissions performance of an appropriate baseline fuel. One or more selected fuel properties can be changed when making this comparison.

Generally, in a predictive model, separate mathematical equations apply to different indicators. For example, a mathematical equation could be developed for an air pollutant such as hydrocarbons; or, a mathematical equation could be developed for a different air pollutant such as the oxides of nitrogen.

A predictive model for vehicle emissions is typically characterized by:

the number of mathematical equations developed, the number and type of motor vehicle emissions tests used in the development of the mathematical equations, and the mathematical or statistical approach used to analyze the results of the emissions tests.

The California Predictive Model is comprised of twelve mathematical equations. One set of six equations predicts emissions from vehicles in Technology Class 3 (model years 1981–1985), another set of six is for Technology Class 4 (model years 1986–1993). For each technology class, one equation estimates the relative amount of exhaust emissions of hydrocarbons, the second estimates the relative amount of exhaust emissions of oxides of nitrogen, and four are used to estimate the relative amounts of exhaust emissions of the four toxic air contaminants: benzene, 1,3-butadiene, acetaldehyde, and formaldehyde. These toxic air contaminants are weighted based on their relative potential to cause cancer, which is referred to as potency-weighting, and then combined.

In creating the California Predictive Model, CARB compiled and analyzed the results of over 7,300 vehicle exhaust emissions tests. A standard statistical approach to develop the mathematical equations to estimate changes in exhaust emissions was used based upon the data collected.

In summary, specific cap limits along with content requirements (see Table 1), and the California Predictive Model, were created by the California Air Resources Board to restrict the formulation of gasoline to ensure the production of gasoline which produces low emissions when used in automobiles.

The gasoline formulations of the present invention contain substantially no oxygenates. By substantially no oxygenates, it is meant that the gasoline formulation contains less than at least one weight percent oxygen, or preferably less than 0.5 weight percent oxygen, and most preferably substantially zero weight percent oxygen. Thus, for the purposes of the present invention, if some oxygen containing compounds are contained in the gasoline formulation, the amount must be far less than that specified for California Phase 2 gasoline when oxygenates are required. Basically, the gasoline formulations of the present invention contain substantially no oxygenates.

Despite the removal of oxygenates, the gasoline formulations of the present invention also offer the advantage of good emissions. This is the case even though the gasoline formulations also fail to meet the CARB specifications with regard to at least one of the prescribed gasoline fuel properties, with particular focus on either the aromatic hydrocarbon content, the 50% D-86 Distillation Temperature specification, or the 90% D-86 Distillation Temperature specification. It has been surprisingly found that despite not meeting the CARB specifications for reformulated gasolines, the gasolines of the present invention offer good performance, and surprisingly low $NO_x$ emissions. In fact, the gasolines of the present invention offer $NO_x$ emissions performance which is substantially better than that predicted by the California Predictive Model.

The unleaded gasoline fuel of the present invention first requires that it be substantially free of oxygenates. The fuel also exhibits a Reid vapor pressure of less than 7.5 psi, more preferably 7.0 or less, and a sulfur content of less than 30 ppmw, more preferably less than 20 ppmw, even more preferably less than 15 ppmw, and most preferably about 10 ppmw or less. The gasoline fuel of the present invention also preferably has a low olefin content, e.g., no greater than 8 volume percent, more preferably 5 volume percent or less and most preferably 2–3 volume percent or less. The unleaded gasoline fuel also exceeds the CARB cap limit specifications for at least one of the other prescribed gasoline fuel properties, and therefore allows for an aromatic hydrocarbon content of greater than 30 volume percent and/or a 50% D-86 Distillation Temperature greater than 220° F., and/or a 90% distillation temperature of greater than 330° F., all of which exceed the California Phase 2 gasoline cap limits shown in Table 1.

Among other factors, therefore, the present invention is based upon the discovery that one can substantially remove all oxygen containing compounds from a fuel formulation, and even go outside of at least one of the prescribed gasoline fuel property specifications developed by CARB, and still obtain an excellent gasoline which produces low emissions when used in automobiles. By maintaining the Reid vapor pressure at less than 7.5 psi, but also maintaining the sulfur content to less than 30 ppmw, and more preferably less than 20 ppmw, it has been found that more flexibility is available to blend gasoline fuels in terms of aromatic content, T50 and T90 specifications. It is also most preferred to maintain the olefin content at no greater than 8 volume percent, preferably 6 volume percent or less, more preferably 5 volume percent or less, even more preferably in the range of 2–3 volume percent or less. The low olefin content is believed to enhance the beneficial effects of the low sulfur. The gasoline formulations of the present invention are particularly advantageous with regard to nitrogen oxide emissions ($NO_x$), for which there is increased concern with regard to the environment.

The gasoline fuel compositions of the present invention are applicable to all gasoline fueled cars, particularly those equipped with a catalytic converter, but have been found to be most advantageous for newer gasoline fueled automobiles, and, in particular, vehicles certified to California Low Emission Vehicle (LEV) standards and beyond. For it is in such newer model cars, as exemplified by the 1998 Ford Contour, with a 2.0 liter engine, and 1997 Nissan Altima, with a 2.4 liter engine, both certified to Transitional Low Emissions Vehicle (TLEV) standards, that particular advantages are seen with regard to $NO_x$ emissions, while also observing acceptable emissions with regard to exhaust hydrocarbons. The gasoline fuel compositions of the present invention are also useful throughout the year, with perhaps some modification in the RVP for seasonal requirements.

In a preferred embodiment of the present invention, the unleaded gasoline fuel is substantially free of oxygenates, has a Reid vapor pressure of less than 7.5 psi, has a sulfur content of less than 30 ppmw, more preferably less than 20 ppmw, and the aromatic hydrocarbon content is greater than 30 volume percent. The unleaded gasoline fuel also preferably has an olefin content of 8 volume percent or less, more preferably 5 volume percent or less.

In another preferred embodiment of the present invention, the unleaded gasoline fuel of the present invention is substantially free of oxygenates, has a Reid vapor pressure of less than 7.5 psi, a sulfur content of less than 30 ppmw, and more preferably less than 20 ppmw, and a 90% D-86 Distillation Point greater than 330° F. The fuel also preferably has an olefin content of 8 volume percent or less, and more preferably 5 volume percent or less.

In another preferred embodiment, the unleaded gasoline fuel is substantially free of oxygenates, has a Reid vapor pressure of less than 7.5 psi, a sulfur content of less than 30 ppmw, and more preferably less than 20 ppmw, and a 50% D-86 Distillation Point greater than 220° F. The fuel also preferably has an olefin content of no greater than 8 volume percent, and more preferably 5 volume percent or less.

In the preferred embodiments of the present invention, the Reid vapor pressure of the gasoline fuels of the present invention are less than 7.5 psi, but are most preferably no greater than 7.0. The sulfur content of the gasoline fuels of the present invention are no greater than 30 ppmw, but are more preferably no greater than 20 ppmw, even more preferably no greater than 15 ppmw. In the most preferred embodiments, the amount of sulfur contained in the unleaded gasoline fuels of the present invention is no greater than 10 ppmw sulfur. The olefin content of the fuel is also preferably maintained at 8 volume percent or less, more preferably at 6 volume percent or less, even more preferably at 5 volume percent or less, and most preferably in the range of 2–3 volume percent or less.

Generally, the lower the sulfur content, the more magnified the beneficial effects observed. Thus, in order to obtain more flexibility, particularly when the aromatics, T-50 and T-90 characteristics are all relatively high, a lower sulfur content would be preferred. It is generally preferred that the T-50 and T-90 characteristics are not high together. Also, as mentioned previously, lower olefin content appears to enhance the beneficial effects of the low sulfur. Therefore, lowering the olefin content in combination with the low sulfur can also help add flexibility to the blending of a gasoline formulation which exhibits good emissions.

The fuels of the present invention are useful in operating automotive vehicles having a spark-ignited internal combustion engine. These fuels perform particularly well in vehicles designed for low exhaust emissions. These include vehicles certified to California Low Emissions Vehicle (LEV) standards and soon to be established Phase 2 LEV standards (LEV II) as well as U.S. Environmental Protection Agency National Low Emissions Vehicle (NLEV) standards, and soon to be established Tier 2 standards. The fuels are introduced into the engine and then combusted in the engine. In a preferred embodiment, the automotive vehicle also has a catalytic converter into which at least some of the engine exhaust emissions created by combusting the unleaded gasoline are introduced. The resulting emissions are then discharged from the vehicle exhaust system to the atmosphere. Most of the emissions are inert, non-harmful components, with the regulated components such as hydrocarbons and $NO_x$ being low. In particular, the emissions have a reduced amount of $NO_x$ emissions. The $NO_x$ emissions, when compared to a baseline fuel, have in fact been discovered to surprisingly surpass even the $NO_x$ emissions indicated by the predictive model developed by the California Air Resources Board. In all cases, the potency-weighted toxic requirements will also be met by means of the reduced amount of oxygenates and olefins and appropriate limits on the amount of benzene.

The invention will be illustrated in greater detail by the following Examples. It is understood that these Examples are given by way of illustration and are not meant to limit the disclosure of the claims to follow.

EXAMPLE 1

In a pilot test program to evaluate emissions, three unleaded gasoline fuels were formulated and tested, which included one baseline fuel (A). The other two fuels, (B) and (C), were blended without oxygenates and did not meet all of the requirements of California Phase 2 gasoline. All three test fuels were stored in barrels in a refrigerated space maintained at 50±5° F. Barrels remained in the storage area for a minimum of 24 hours prior to being opened. They remained in the cooled area until they were depleted or the test program was completed. RVP (Reid vapor pressure) samples were drawn from the barrels when they were opened (full) and as they approached depletion (10–20% capacity). RVP determinations were made with a Grabner Instruments CCA-VPS vapor pressure tester. Each batch of samples included a cyclopentane reference sample to insure analyzer integrity.

Testing was performed in accordance with "California Exhaust . . . Standards and Test Procedures for 1988 and Subsequent Model . . . Vehicles" (CCR Sec. 1960. 1), except those portions relating to evaporative emissions. The tests were made with two recent model California vehicles certified to TLEV standards, a 1998 Ford Contour and a 1997 Nissan Altima. Additional preconditioning was performed to insure that as much of the fuel from previous tests as possible was drained and removed from the fuel tank and fuel delivery system. This preconditioning ended with a standard drain and fill to 40% capacity, UDDS (Urban Dynamometer Driving Schedule) dynamometer preconditioning, and overnight soak prior to the exhaust emissions test.

Each vehicle received a minimum of one test with each of the test fuels, including the baseline fuel. The order of testing of the fuels was completely randomized for each vehicle. All tests on a given vehicle were performed consecutively—vehicles were not left idle for extended periods while other program vehicles were being tested. The tests on a vehicle were performed on consecutive days.

Fuel injected vehicles generally provide an access port in the pressurized fuel line which was used to drain the vehicle fuel tank by activating the on-board fuel pump. A significant amount of fuel remained in the fuel tank below the fuel pump pickup, however. Repeated fills and drains were performed to dilute the fuel from a previous test with fuel for the upcoming test. Some engine operation was also required to purge the fuel line from the tank to the engine and from any bypass from the fuel rail back to the fuel tank. Modern feedback engine control systems also feature adaptive learning subsystems to provide baseline information regarding previous engine operation while the engine is warming up. Preconditioning was designed to insure that any calibration changes resulting from the adaptive learning process were fully completed with the new fuel.

The preconditioning procedure included:

1. Draining the fuel tank and adding a 20–25% fill of fresh test fuel. Idling engine for 5 minutes.
2. Draining the fuel tank and adding a 20–25% fill of fresh test fuel. Performing one LA-4 and one HFET during schedule on the dynamometer.
3. Soaking vehicle in controlled temperature soak room for a minimum of one hour.
4. Draining and filling to 40% capacity with fresh test fuel. Performing LA-4 dynamometer preconditioning. Soaking in controlled temperature soak room until the vehicle was transferred to the test cell for the FTP.

The multiple drains and fills insured that the amount of fuel remaining from previous tests was minimized. The engine operation and soaks provided ample opportunity for any adaptive learning process to stabilize with the new fuel. The final steps insured compliance with the CCR requirements for the exhaust emission test.

The FTP exhaust emissions test included measurement of non-methane hydrocarbons (NMHC), and $NO_x$ in accordance with Federal and California test procedures.

GC bag samples were collected for each test phase of the FTP (3 bags), with dilution air sample collection of the Cold Transient and Stable phase combined, and the Hot Transient Phase (2 background bags). GC samples were collected on tests of the 1998 Ford Contour. The samples were processed on a GC, but peak identification and quantification of results was not performed.

Subtle changes in exhaust emissions and fuel economy may be overshadowed by test to test variability. Changes in some fuel properties typically result in small, difficult to measure, changes in exhaust emissions. Procedures developed for ASTM testing of fuel efficient engine oils have been demonstrated to greatly improve test repeatability, and were applied to tests in this program. Careful attention was given to preconditioning and soak conditions to further assure consistency in the tests. The same driver was used to drive the FTP cycle throughout testing of each particular car.

The results of the testing are shown in Table 2 below. The Table presents the inspection results of the key fuel properties of the three test fuels. It also summarizes the change in emissions of the two fuels of the present invention (Fuels B and C) compared to the baseline or reference fuel (Fuel A). The summary is identified in Table 2 as the Actual Results. The reference fuel essentially meets California Air Resources Board specifications for Phase 2 emissions certification fuels (California Phase 2 Certification fuel). The California Phase 2 Certification fuel is also specified for use in demonstrating alternate fuel emissions equivalence under CARB's Vehicle Test Option substitute fuel qualification procedure.

TABLE 2

Emission Results for Test fuels in 1998 Ford Contour and 1997 Nissan Altima

| | Fuel A (Baseline) | Fuel B | Fuel C |
|---|---|---|---|
| Oxygen (wt %) | 1.87 | 0.02 | 0.05 |
| Aromatics (vol %) | 22.6 | 33.4 | 30.9 |
| Olefins (vol %) | 4.7 | 1.7 | 1.95 |
| 50% D86 Distillation Temperature (° F.) | 201 | 221 | 200 |
| 90% D86 Distillation Temperature (° F.) | 303 | 302 | 319 |
| Sulfur (ppmw) | 41 | 12.6 | 10 |
| Benzene (vol %) | 0.51 | 0.46 | 0.44 |
| Reid Vapor Pressure (psi) | 6.6 | 6.9 | 7.3 |
| Gravity (° API) | 60 | 57.4 | 57.6 |
| (R + M)/2 | 90.2 | 89.4 | 84.8 |

TABLE 2-continued

Predictive Model Predictions and Actual Differences from the Baseline Fuel, %

| | | | |
|---|---|---|---|
| *NMHC | Predictive Model | 10.8 | 3.1 |
| | Actual Results | 23.9 | −1.5 |
| $NO_x$ | Predictive | −2.34 | −2.9 |
| | Actual Results | −28.0 | −11.3 |

*Non-methane hydrocarbons.

As can be seen from the foregoing results, fuels B and C, which are in accordance with the present invention, contain no oxygenates and have aromatic contents greater than 30 volume percent. The two fuels also provided surprising improvements in the $NO_x$ emissions not anticipated by the Predictive Model. The Predictive Model was employed to demonstrate the expected change in $NO_x$ by each test fuel as compared to the baseline fuel A (which fuel essentially meets the requirements of California Air Resources Board for Phase 2 gasoline). While some reduction in $NO_x$ was indicated for Fuels B and C, the reductions observed were from three to ten times that predicted by the present California Predictive Model. This result was quite surprising, particularly in light of the fact that the gasoline did not meet the California Phase 2 gasoline specifications. Nevertheless, the gasolines in accordance with the present invention apparently offer one the ability to provide a substantially oxygenate free fuel which also exhibits low emissions, particularly with regard to nitrogen oxides.

The foregoing results are graphically depicted in The FIGURE of the Drawing with regard to hydrocarbons and $NO_x$.

EXAMPLE 2

Following the test procedures used in Example 1, it is believed that the following compositions described in Table 3 would also exemplify other fuels in accordance with the present invention which would exhibit the surprising emissions reductions.

TABLE 3

Gasoline Fuels

| D | Fuel E | Fuel F | Fuel G | Fuel H | Fuel I | Fuel J | Fuel K | Fuel L | Fuel M | Fuel N | Fuel O | Fuel |
|---|---|---|---|---|---|---|---|---|---|---|---|---|
| Oxygen (wt %) | 0 | 0 | 0 | 0 | 0 | 0 | 0 | 0.5 | 0.5 | 0.75 | 0 | 0 |
| Aromatics (vol %) | 30 | 35 | 28 | 32 | 32 | 30 | 35 | 35 | 25 | 28 | 30 | 35 |
| Olefins (vol %) | 4 | 4 | 4 | 2 | 6 | 6 | 5 | 4 | 3 | 3 | 6 | 2 |
| Temperature at 50% distilled | 230 | 215 | 225 | 230 | 210 | 215 | 225 | 210 | 210 | 205 | 210 | 205 |
| Temperature at | 290 | 310 | 300 | 295 | 335 | 340 | 320 | 335 | 335 | 340 | 340 | 330 |

TABLE 3-continued

| | Gasoline Fuels | | | | | | | | | | | |
|---|---|---|---|---|---|---|---|---|---|---|---|---|
| 90% distilled | | | | | | | | | | | | |
| Sulfur (ppmw) | 15 | 15 | 10 | 10 | 20 | 5 | 15 | 10 | 15 | 30 | 15 | 15 |
| Benzene (vol %) | 0.5 | 0.5 | 0.5 | 0.5 | 0.3 | 0.3 | 0.2 | 0.3 | 0.5 | 0.2 | 0.3 | 0.5 |
| RVP (psi) | 7.5 | 7 | 7 | 7 | 7.5 | 7.0 | 7.0 | 7.0 | 7.0 | 7.0 | 7.5 | 7.0 |

| | Fuel P | Fuel Q | Fuel R | Fuel S | Fuel T | Fuel U | Fuel V | Fuel W | Fuel X | Fuel Y | Fuel Z |
|---|---|---|---|---|---|---|---|---|---|---|---|
| Oxygen (wt %) | 0.5 | 0 | 0.25 | 0 | 0 | 0.25 | 0 | 0 | 0.25 | 0 | 0 |
| Aromatics (vol %) | 32 | 36 | 32 | 35 | 25 | 24 | 32 | 32 | 32 | 35 | 30 |
| Olefins (vol %) | 4 | 2 | 8 | 2 | 1 | 3 | 2 | 2 | 1.5 | 2 | 2 |
| Temperature at 50% distilled | 210 | 210 | 205 | 220 | 195 | 200 | 225 | 200 | 205 | 205 | 200 |
| Temperature at 90% distilled | 300 | 305 | 335 | 290 | 340 | 335 | 300 | 330 | 335 | 330 | 340 |
| Sulfur (ppmw) | 20 | 10 | 10 | 10 | 25 | 20 | 15 | 10 | 20 | 10 | 10 |
| Benzene (vol %) | 0.5 | 0.5 | 0.4 | 0.5 | 1.0 | 1.0 | 0.8 | 0.9 | 0.7 | 0.6 | 0.7 |
| RVP (psi) | 7.0 | 7.0 | 7.0 | 7.0 | 7.5 | 7.0 | 7.0 | 7.0 | 7.0 | 7.0 | 7.0 |

One of the main advantages of the invention is that a less polluting substantially oxygenate free gasoline fuel is provided that can be more easily prepared in a petroleum refinery or the like. That is, in a typical refinery in which gasoline is produced for sale, particularly in California, it is necessary or at least desirable in most instances to blend the hydrocarbon stocks so as to produce gasolines of specified Reid vapor pressure, and which meet all of the CARB Phase 2 gasoline requirements. In addition, gasoline must meet other specifications, such as octane, to assure good performance of the automobile. Thus, the only difference is that now the refinery will blend the stocks in light of the information provided herein such that the emissions are reduced, particularly the $NO_x$ emissions, as much as required or practicable, given the individual situation (the blend stocks available, refinery capacity, etc.) facing the particular refinery. By following the present invention, more flexibility is offered in blending the fuels, particularly with regard to the aromatic hydrocarbon content, the T50 and T90 specifications. Yet, an environmentally friendly fuel is provided which offers good performance and surprisingly low $NO_x$ emissions, as well as flexibility in blending.

While the invention has been described with preferred embodiments, it is to be understood that variations and modifications may be resorted to as will be apparent to those skilled in the art. Such variations and modifications are to be considered within the purview and the scope of the claims appended hereto.

What is claimed is:

1. A method for preparing an unleaded gasoline, which comprises controlling the blending of components such that the amount of sulfur is no greater than 15 ppmw, the blend is substantially free of oxygenates, and at least one of the aromatic content, benzene content, olefin content, T-50 or T-90 characteristics is greater than the cap limits for the Phase 2 California reformulated gasoline.

2. The method of claim 1, wherein the amount of sulfur is no greater than 10 ppmw.

3. The method of claim 1, wherein the aromatic hydrocarbon content is greater than 30 volume percent.

4. The method of claim 3, wherein the olefin content is 8 volume percent or less.

5. The method of claim 3, wherein the olefin content is 6 volume percent or less.

6. The method of claim 3, wherein the aromatic hydrocarbon content is at least 32 volume percent.

7. The method of claim 3, wherein the aromatic hydrocarbon content is at least 35 volume percent.

8. The method of claim 3, wherein the fuel has a 90% D-86 Distillation Temperature of no greater than 300° F.

9. The method of claim 3, wherein the fuel has a 90% D-86 Distillation Point no greater than 330° F.

10. The method of claim 3, wherein the fuel has a 50% D-86 Distillation Point no greater than 220° F.

11. The method of claim 3, wherein the fuel has a 50% D-86 Distillation Point no greater than 210° F.

12. The method of claim 1, wherein the fuel has a 90% D-86 Distillation Point greater than 330° F.

13. The method of claim 1, wherein the fuel blend has a 50% D-86 Distillation Temperature greater than 220° F.

14. The method of claim 1, wherein the unleaded gasoline prepared has a Reid vapor pressure of less than 7.5.

15. The method of claim 1, wherein the unleaded gasoline prepared has a Reid vapor pressure of less than 7.0.

16. The method of claim 1, wherein the unleaded gasoline fuel has a Reid vapor pressure of less than 7.5 psi;

an aromatic hydrocarbon content greater than 30 volume percent;

a 50% D-86 Distillation Point no greater than 220° F.; and an olefin content of 6 volume percent or less.

17. The method of claim 16, wherein the amount of sulfur is not greater than 10 ppmw.

18. The method of claim 1, wherein the unleaded gasoline fuel blended has a Reid vapor pressure of less than 7.5 psi; and a 50% D-86 Distillation Temperature greater than 220° F.

19. The method of claim 18, wherein the unleaded gasoline fuel has a sulfur content of no greater than 10 ppmw.

20. The method of claim 1, wherein the unleaded gasoline fuel has a Reid vapor pressure of less than 7.5 psi;

a 50% D-86 Distillation Point greater than 220° F.;

a 90% D-86 Distillation Point of no greater than 330° F.; and an olefin content of less than 6 volume percent.

21. The method of claim 20, wherein the sulfur content is no greater than 10 ppmw.

22. The method of claim 1, wherein the unleaded gasoline fuel has a Reid vapor pressure of less than 7.5 psi; and a 90% D-86 Distillation Temperature greater than 330° F.

23. The method of claim 22, wherein the sulfur content is no greater than 10 ppmw.

24. The method of claim 1, wherein the unleaded gasoline fuel exhibits a reduction in $NO_x$ from at least 3 to 10 times that predicted by the California Predictive Model when combusted in an internal combustion engine of a 1998 Ford Contour or a 1997 Nissan Altima.

25. The method of claim 2, wherein the unleaded gasoline fuel exhibits a reduction in $NO_x$ from at least 3 to 10 times that predicted by the California Predictive Model when combusted in an internal combustion engine of a 1998 Ford Contour or a 1997 Nissan Altima.

* * * * *